United States Patent [19]

Brasky

[11] Patent Number: 4,525,019

[45] Date of Patent: Jun. 25, 1985

[54] SELF-STRIPPING CONNECTOR FOR INSULATED WIRES

[76] Inventor: Joseph L. Brasky, 15 Tower Hill Rd., Killingworth, Conn. 06417

[21] Appl. No.: 609,490

[22] Filed: May 11, 1984

Related U.S. Application Data

[63] Continuation of Ser. No. 351,642, Feb. 23, 1982, abandoned.

[51] Int. Cl.[3] ..... H01R 9/08

[52] U.S. Cl. ..... 339/98; 339/97 P; 339/99 R

[58] Field of Search ..... 339/97 R, 97 P, 98, 339/99 R

[56] References Cited

U.S. PATENT DOCUMENTS

| | | | |
|---|---|---|---|
| 3,258,733 | 6/1966 | Elm | 339/98 |
| 3,793,611 | 2/1974 | Johansson | 339/98 |
| 3,812,449 | 5/1974 | Elm | 339/98 |
| 3,920,305 | 11/1975 | Scott | 339/98 |

FOREIGN PATENT DOCUMENTS

| | | | |
|---|---|---|---|
| 1198435 | 8/1965 | Fed. Rep. of Germany | 339/98 |
| 1525382 | 4/1968 | France | 339/98 |

*Primary Examiner*—William R. Briggs

*Attorney, Agent, or Firm*—McCormick, Paulding & Huber

[57] ABSTRACT

A self-stripping connector having an insulative body member, two flat conductive contact elements and an insulative cover for effecting a double T-splice involving a pair of insulated run wires and end portions of two additional insulated wires. The body portion defines two elongated through channels and two elongated openings for receiving two run wires and two wire end portions, respectively. Each of two thin slots, defined in the body member, are in communication with one channel and one slot and receive the thin contact elements. The contact elements have insulation-penetrating fingers which engage the conductors of the wires and form an electrical connection therebetween. Portions of the contact elements exposed in the body member are protected by the insulative cover. The connector is particularly well suited for effecting parallel connections in a radiant heating panel assembly.

1 Claim, 7 Drawing Figures

SELF-STRIPPING CONNECTOR FOR INSULATED WIRES

This application is a continuation of application Ser. No. 351,642, filed 02-23-82, abandoned.

BACKGROUND OF THE INVENTION

This invention relates to wire connectors, and more particularly, to self-stripping connectors for making electrical connections between insulated wires.

While connecting wires in an electrical wiring assembly, it occasionally becomes necessary to electrically join an end portion of an insulated wire to an insulated run, or continuous, wire already wired in the assembly. To effect this necessary joinder, commonly referred to as a T-splice, a conventional self-stripping connector similar to the type described in U.S. Pat. No. 4,033,661 can be utilized. If in an electrical wiring assembly, it is desired to wire an element having two insulated lead wires in parallel with a power supply having two insulated run wires, two T-splices are necessary. In a parallel arrangement involving such an element and two power wires, one T-splice joins one element lead wire to one power wire and the other T-splice joins the other element lead wire to the other power wire. To make the necessary T-splices, two conventional self-stripping connectors are commonly used. However, there are obvious cost and convenience disadvantages associated with using two connectors where one connector will suffice.

It is, therefore, a general object of this invention to provide a self-stripping connector for effecting a double T-splice between a pair of insulated run wires and end portions of two additional insulated wires in order to facilitate and reduce the cost of making such connections by conventional means.

It is another object of this invention to provide a connector for use with a radiant heating panel assembly of the type generally supported along room ceilings for the purpose of providing a radiant heat to a room.

SUMMARY OF THE INVENTION

The present invention relates to a connector for effecting a double T-splice involving a pair of insulated run wires and end portions of two additional insulated wires. The connector or comprises an insulative body member, two thin flat conductive contact elements, and a cover. The insulative body member may be in the form of a rectangular block defining a pair of elongated through channels extending between opposite ends of the block and further defining first and second elongated openings extending toward one another from opposite ends. Each channel is adapted to receive and securely retain an insulated run wire laterally urged into the channel. Each of the first and second openings is adapted to receive an end portion of insulated wire. The rectangular body member still further defines two thin slots extending from the top of the block so that each slot is in communication with one of the channels and one of the openings of the block.

Each thin flat conductive contact element has a head portion and spaced wire-receiving fingers extending opposite the head portion. The contact elements are of such size and shape as to be slidably entered in the thin slots defined in the rectangular block, and the fingers of each contact element are adapted to engage the conductors of insulated wires positioned within the channel and opening communicating with its slot to form electrical contact between the conductors.

The cover is fastenable over the insulative body member for enclosing the head portions of the contact elements when the elements are fully inserted within their respective slots.

In a presently intended use of the connector of this invention, the connector is an integral part of an electrical radiant heating panel assembly connected in parallel to a pair of insulated power wires. The radiant heating panel includes an electrical resistance heating wire having a major portion extending in the body of the panel and having two insulated leads or wire end portions protruding from one edge of the panel. The connector is used to effect a parallel connection between the two insulated leads and a pair of insulated power wires.

DETAILED DESCRIPTION OF THE PREFERRED EMBODIMENTS

Figure 1:
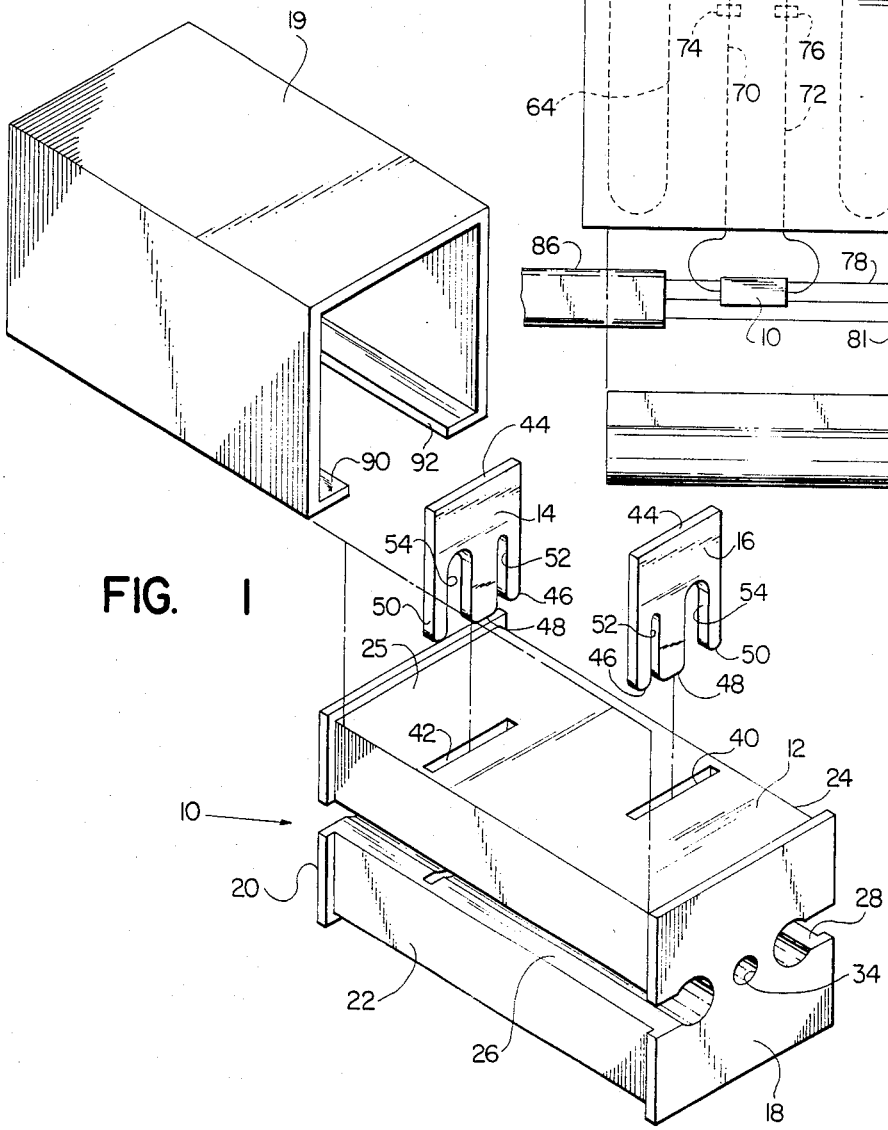
FIG. 1 is an exploded perspective view of a connector of this invention.

Referring now to the drawings, there is illustrated in FIG. 1 a connector of this invention indicated generally at 10, comprising an insulative body member 12, two thin flat conductive contact elements 14, 16, and a cover 19. The insulative body member 10 is formed generally in the shape of a rectangular block from a suitable electrical insulating material such as a non-conducting plastic, preferably adaptable to injection molding techniques. The body member 10 has opposite ends 18, 20; opposite sides 22, 24; and a top 25. The ends 18, and 20 are substantially planar and parallel to one another while the sides 22 and 24 extend between and are generally perpendicular to the opposite ends. The top 25 extends between and is generally perpendicular to the opposite ends and sides.

Figure 2:
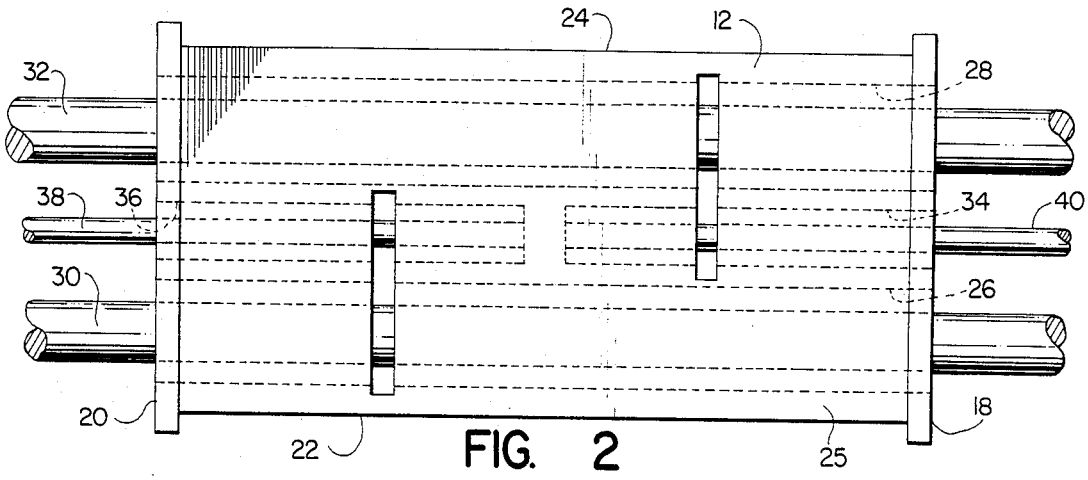
FIG. 2 is a top plan view of the body member of the FIG. 1 connector and shows insulated wires positioned therewithin.
Figure 3:
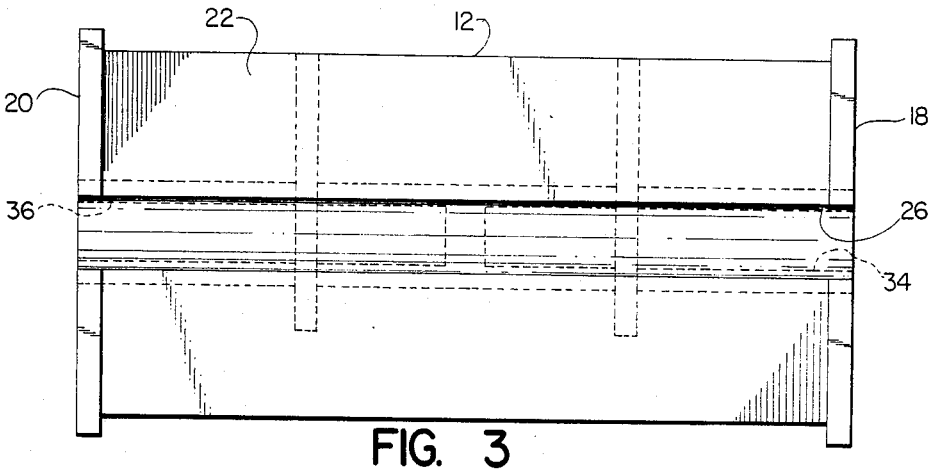
FIG. 3 is a side elevational view of the body member of FIG. 2.
Figure 4:
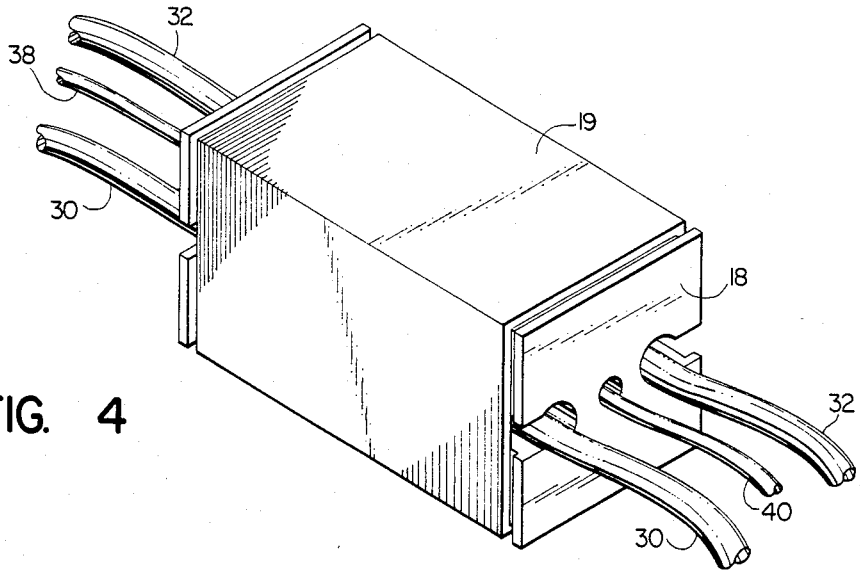
FIG. 4 is a perspective view of the assembled FIG. 1 connector and shows the insulated wires positioned therewithin.

Referring to FIGS. 1 to 4, the body member 12 defines a pair of elongated through channels 26 and 28 extending between the opposite ends and communicating laterally with the sides 22 and 24, respectively. The through channels each have a narrow neck portion and a wider interior portion so as to provide for lateral snap entry of run wires into the channels. Preferably, the diameter of the interior of each channel is roughly equal to the diameter of the run wire to be received therein so that once the run wires 30 and 32, shown received in their respective channels in FIG. 2, are positioned in the channels, the wires are securely retained.

The body member also defines first and second elongated openings 34, 36 extending toward each other from opposite ends 18 and 20. The openings are of such diameter as to receive end portions of insulated wires 38, 40 to be connected in T-splice arrangements to the run wires 30, 32. The elongated openings 34, 36 and through channels 26, 28 are arranged so that their longitudinal centerlines are generally parallel to one another and to the top 25 of the body member 12.

The body member 12 still further defines two thin lateral slots 40, 42, each slot extending downwardly from the top 25 and in communication with one of the through channels and one of the elongated openings.

Referring to FIG. 1, the thin flat conductive elements 14 and 16 each have a head portion 44 and three spaced wire-receiving fingers 46, 48, 50 extending opposite the head portion. Each contact element is of such size and shape as to be slidably received within a separate one of the thin body member slots 40, 42. The spaces between the three fingers provide two slots 52, 54 which respectfully align with the channel and opening when the element is received within its respective body slot. Each slot 52 and 54 has a width which corresponds generally to the diameter of the core conductor of the insulated wire to be received within the channel or opening. Thus, when the insulated wires are positioned in the body member 12 and the contact elements 14, 16 are inserted within their respective slots, the wire-receiving fingers penetrate the wire insulation and form an electrical connection between the wire conductors.

The cover 19 of the connector 10 is fastenable about the body member 12 to provide an insulative covering for the head portions of the fully inserted contact elements 14 and 16. Like the body member, the cover 19 is formed from a suitable electrically insulative material, preferably a non-conducting resilient plastic. In order to fasten the cover 19 about the body member, tabs 90, 92 formed at the base of the cover are slightly pulled apart to receive the top 25 of the body member while the cover is pressed downwardly onto the body member. When the tabs 90, 92 reach the bottom of the body member, they are allowed to spring toward one another and lock the cover snugly about the body member.

Figure 5:
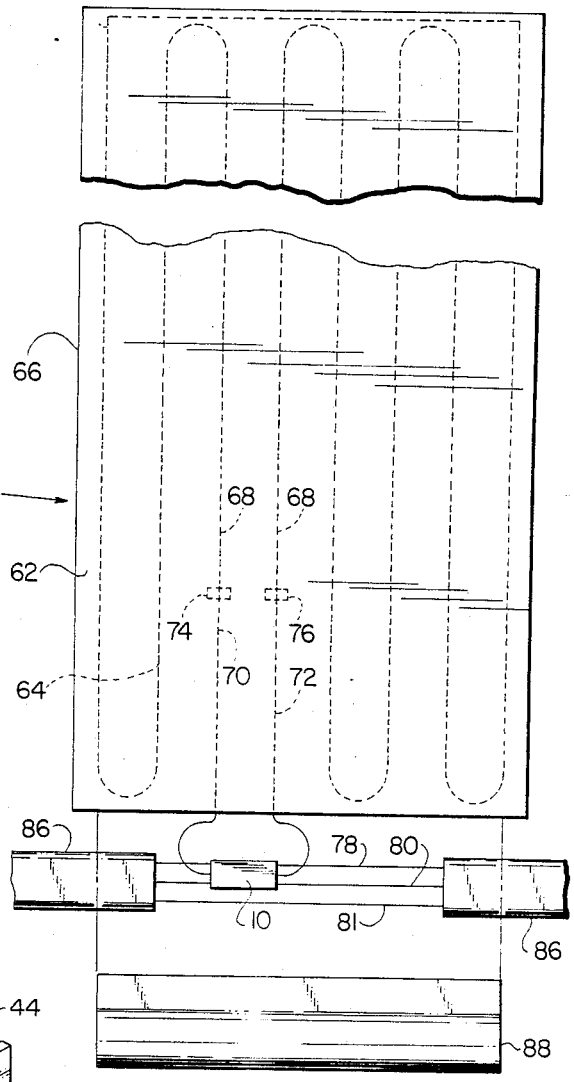
FIG. 5 is an exploded view of the radiant heating panel assembly including the connector of this invention.

In its presently preferred application, the connector 10 is utilized in a radiant heating panel assembly. Referring to FIG. 5, the radiant heating panel assembly, indicated generally at 60, includes a radiant heating panel 62 and a connector 10. The heating panel 62 is comprised of a flat rectangular layer of gypsum 66 having an electrical resistance heating wire 64 embedded therewithin. A major portion 68 of the heating wire 64 extends in the body of the panel 66 in a serpentine fashion and is connected at its ends to insulated leads 70, 72 at junctions 74, 76 disposed within the panel. The two insulated leads 70, 72 protrude from one edge of the panel 66 for connection in parallel to a pair of insulated power wires 78 and 80.

Figure 6:
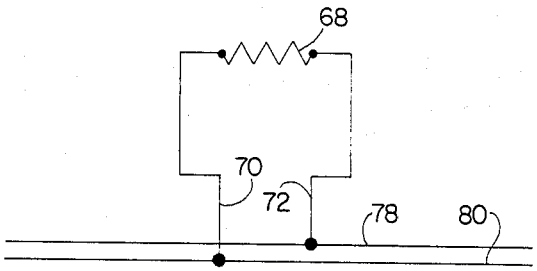
FIG. 6 diagrammatically illustrates the electrical connections of a heating panel to its power supply lines.

FIG. 6 diagrammatically illustrates the electrical connections between the heating panel 66 and power wires 78 and 80. Each of the leads 70, 72 are joined to a separate one of the power wires 78, 80 to connect the heating panel in parallel with a power source.

Referring to FIG. 5, power wires 78, 80 are generally encased along their length by an outer insulative covering 86, 86 together with a third wire 81 which may be a ground wire. To provide access to the power wires a portion of the covering 86 is necessarily removed. The connector 10 is used to effectuate the electrical joinder between the insulated leads 70, 72 and the power wires 78, 80 which also carry individual insulating covers. To enclose the wiring assembly, an optional assembly cover 88 as shown in FIG. 5 may be used about the wiring connections of the assembly. The cover 88 is adapted to be slidably received over an edge of the radiant heating panel 66 while enclosing the leads 70, 72 of the heating wire 64, the connector 10, and a portion of the power wires 78, 80 in assembled relationship.

Figure 7:
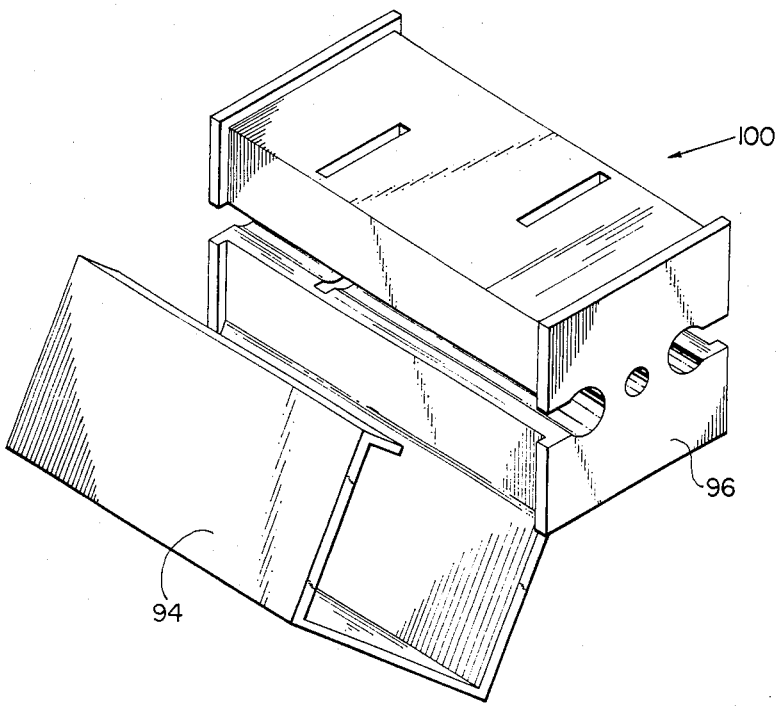
FIG. 7 is a perspective view of an alternative embodiment of the connector of this invention.

It will be understood that numerous modifications may be made to the connector and radiant heating panel assembly of this invention without departing from the spirit of the invention. As an example of an alternative embodiment of the connector of this invention, reference may be had to FIG. 7 showing a cover 94 hingedly attached to the underside of the connector body member 96. The cover 94 swings about the body member 96 between open and closed positions. In an alternative embodiment of the heating panel assembly of this invention, the assembly of FIG. 5 incorporates the connector 100 of FIG. 7 rather than the connector 10 shown in FIG. 5. Accordingly, the disclosed embodiments are intended as illustrative only and not as limitations.

I claim:

1. In an electrical radiant heating panel assembly for connection in parallel to a pair of insulated power wires of opposite polarity and which extend in a closely spaced parallel relationship with each other, the combination comprising:

(a) a radiant heating panel including an electrical resistance heating wire having a major portion extending in the body of the panel and two insulated lead end portion protruding from one edge of the panel for connection in parallel to the pair of insulated power wires of opposite polarity, a connector including (a) an insulative body member in the form of a generally rectangular block having opposite sides and a top, said body member defining a pair of elongated through channels extending between said opposite ends and arranged on opposite sides of the member, each channel opening outwardly and having a narrow neck portion and a wider interior portion so as to receive and securely retain an insulated power wire urged sideways in a snap action and in a lateral direction into said interior portion of the channel, said body member thus being supported in suspended relationship between said spaced parallel power wires, said body member further defining first and second elongated openings extending toward one another from said opposte ends but insulated form one another, said first and second openings being approximately concentric and arranged end-to-end between and in closely spaced relationship with said channels in said body member, and said first and second openings being adapted respectively to receive and position longitudinally said lead wire end portions in an endwise entry movement of the end portions, and said body member still further defining two thin slots, each slot extending from said body member top surface and in communication with one of said channels and one of said openings, (b) two thin flat resilient conductive contact elements each having a head portion and spaced wire-receiving slots defined by fingers extending opposite the head portion, each of said contact elements being of such size and shape as to be slidably received within a separate one of said thin body member slots, and said fingers of each contact element adapted to engage the conductors of isulated wire positioned within the channel and opening communicating with its slot to form electrical contact between the conductors, and (c) a cover fastenable over the insulative body member for covering the head portions of the contact elements and securing the same in fully inserted condition within their respective slots, said cover also extending over said narrow neck portion of each of said channels and thus positively retaining said power wires against accidental lateral dislodgement from their respective channels.

* * * * *